US006942002B1

(12) United States Patent
Williams

(10) Patent No.: US 6,942,002 B1
(45) Date of Patent: Sep. 13, 2005

(54) PRIVACY SCREENS

(76) Inventor: Kevin M. Williams, 35 McGrath Dr., Middletown, CT (US) 06457

( * ) Notice: Subject to any disclaimer, the term of this patent is extended or adjusted under 35 U.S.C. 154(b) by 0 days.

(21) Appl. No.: 09/531,295

(22) Filed: Mar. 20, 2000

(51) Int. Cl.[7] ..... A47G 5/02
(52) U.S. Cl. ..... 160/265
(58) Field of Search ..... 160/265, 266, 160/80, 45, 240, 333

(56) References Cited

U.S. PATENT DOCUMENTS

| | | | | |
|---|---|---|---|---|
| 160,290 | A | * | 3/1875 | Trenchard |
| 1,012,239 | A | * | 12/1911 | Bourne |
| 2,055,862 | A | * | 9/1936 | Friedman |
| 6,006,811 | A | * | 12/1999 | Brutsaert |
| 6,276,430 | B1 | * | 8/2001 | Wu et al. |

FOREIGN PATENT DOCUMENTS

| | | | | |
|---|---|---|---|---|
| FR | 2594480 | * | 9/1987 | ..... 160/121.1 |

* cited by examiner

*Primary Examiner*—Blair M. Johnson
(74) *Attorney, Agent, or Firm*—Nath & Associates PLLC; Gregory B. Kang; Derek Richmond

(57) ABSTRACT

In order to enclose selected areas of a property from viewing by strangers, a structure is provided employing canisters with telescoping members. Screen rolls are provided which can be strung between the telescoping members when they are raised to a height desired by the user to screen an area from strangers to the owners of the property. The telescoping members may be driven between raised and lowered positions by a motor or a hand crank. In one embodiment, the structure is associated with a deck which may extend from a house, in which case the canisters may be secured to the deck floor or legs of the deck. In the alternative, the canisters may be buried full depth in the ground and the telescoping members rise out of the ground to support the screens.

11 Claims, 8 Drawing Sheets

PRIVACY SCREENS

FIELD OF THE INVENTION

The present invention relates to outdoor privacy screens and more particularly to screens that may be erected as needed around outdoor patios or other areas primarily in a region about the premises on which a home is situated.

BACKGROUND OF THE INVENTION

In many modern homes there are outdoor patios, swimming pools, party areas and the like. It is often, particularly with patios and swimming pools, desirable to shield the area from on-lookers, neighbors, neighbor's children, dogs and the like. Privacy in this modern era is a rare commodity, even about one's home. There are times however when it is not desired to shield such an area, particularly when the owner is away from home for a period of time since such a screen would provide an excellent shelter for a person attempting to enter a home illegally.

BRIEF DESCRIPTION OF THE INVENTION

According to the present invention, an assembly is provided for quickly and easily erecting sheltering screens to block the view of onlookers.

Two quite different embodiments are provided, although the underlying concept is the same. In a first embodiment, the screens are to cooperate with a railing about, for instance, a patio. The main support for the structure in this embodiment is the floor of the patio and the patio railing that helps support the screens with telescoping members.

In a second embodiment, a stand-along structure is provided with the supports for the screen sunk in the ground; the support constituting a canister sunk in the ground and carrying the telescoping members the top of which is level with the ground.

In both embodiments the screens are carried on a spring-biased roll, much as a window screen. In the first embodiment of the invention the screen rolls are situated in a canister supported below and parallel to the railing around the area to be protected. The roll will most likely be located along the exterior of the patio floor boards. Supports are telescoping members carried in canisters and may be raised by any electric motor. The supports may be attached to the legs of the patio if it is raised on legs, the patio rails, or may be sunk in the ground as in the second embodiment of the invention.

In the second embodiment of the invention, canisters are sunk in the ground to a depth that can accommodate the canister containing the screens and enough telescoping members of a length to provide the desired screening effect. If an eight foot screen is desired, then a canister with two foot long telescoping member should be sunk approximately two feet in the ground. The telescoping members, four in number, for instance, will each rise a height of two feet, for a total of 8 feet, much like a retractable automobile antenna. The top of the canisters should be flush or slightly below the ground so that they do not present obstacles when not in use.

The canisters sunk in the ground should be embedded in a concrete or heavy duty plastic trough so as to support the structure in the presence of moderate (30 mph) winds. An attached rubber flap cover to protect the canister from rain should lay across the top of the concrete support structure. The flap would be light weight enough to raise when the screen is raised and it would fall back down when the screen is lowered. In this embodiment the screen rolls can be removed and stored in the house or in a shed.

The above and other features, objects and advantages of the present invention, together with the best means contemplated by the inventor thereof for carrying out the invention will become more apparent from reading the following description of a preferred embodiment and perusing the associated drawings in which:

DETAILED DESCRIPTION OF THE PRESENT INVENTION

Figure 1:
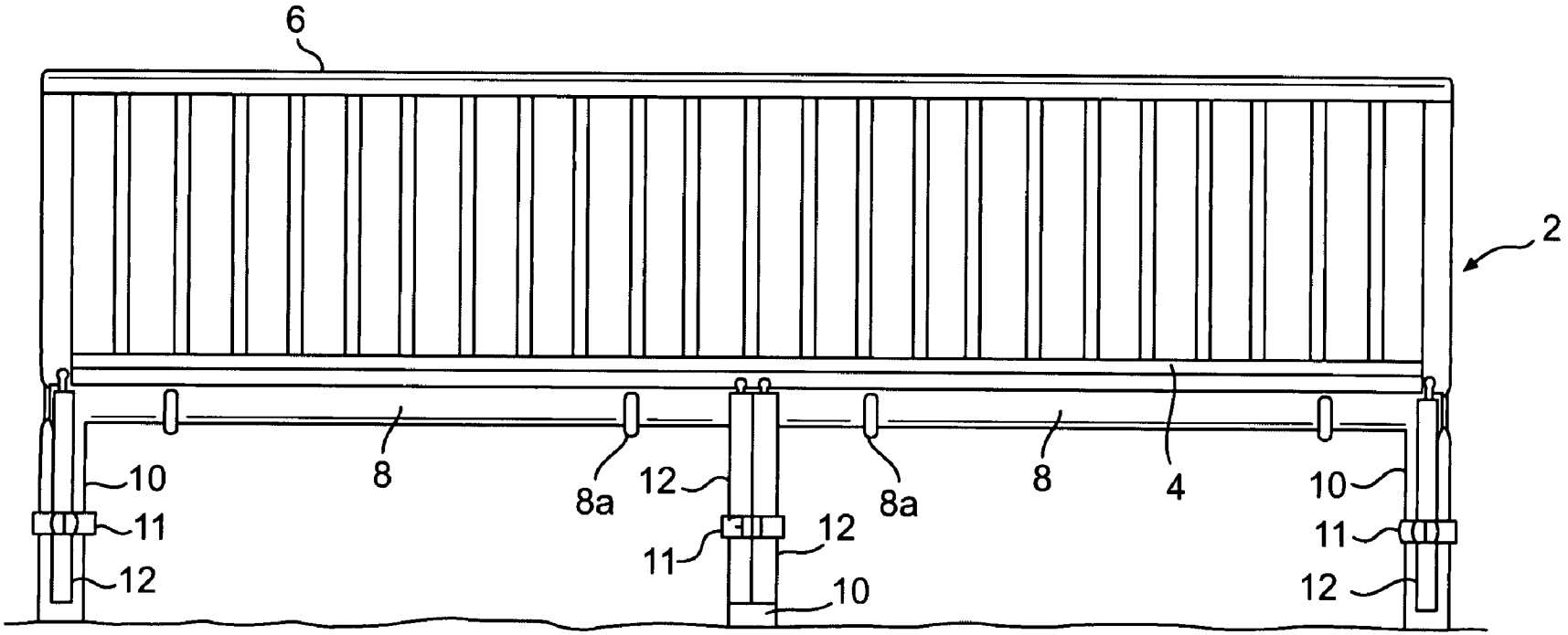
FIG. 1 illustrates a front view in elevation of the structure supplying and supporting a screen according to the present invention.
Figure 2:
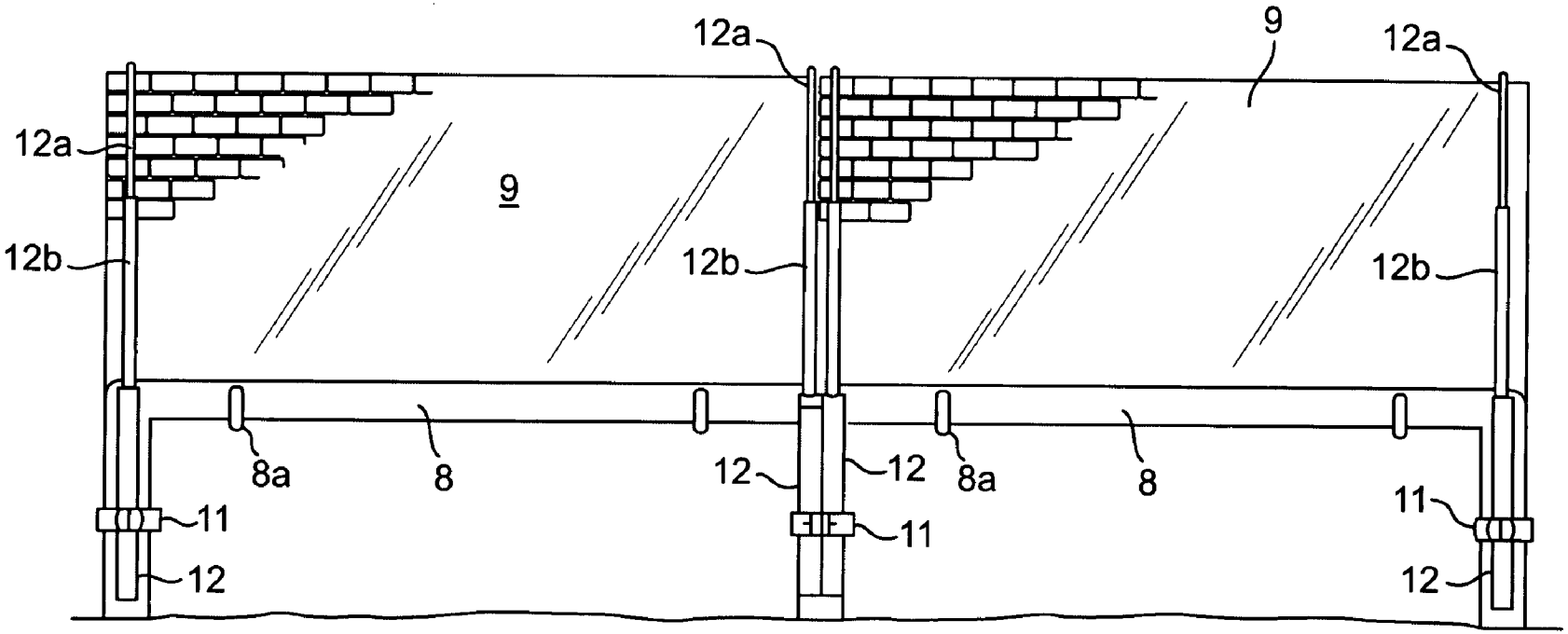
FIG. 2 is a front view in elevation of a partially erected screen.
Figure 3:
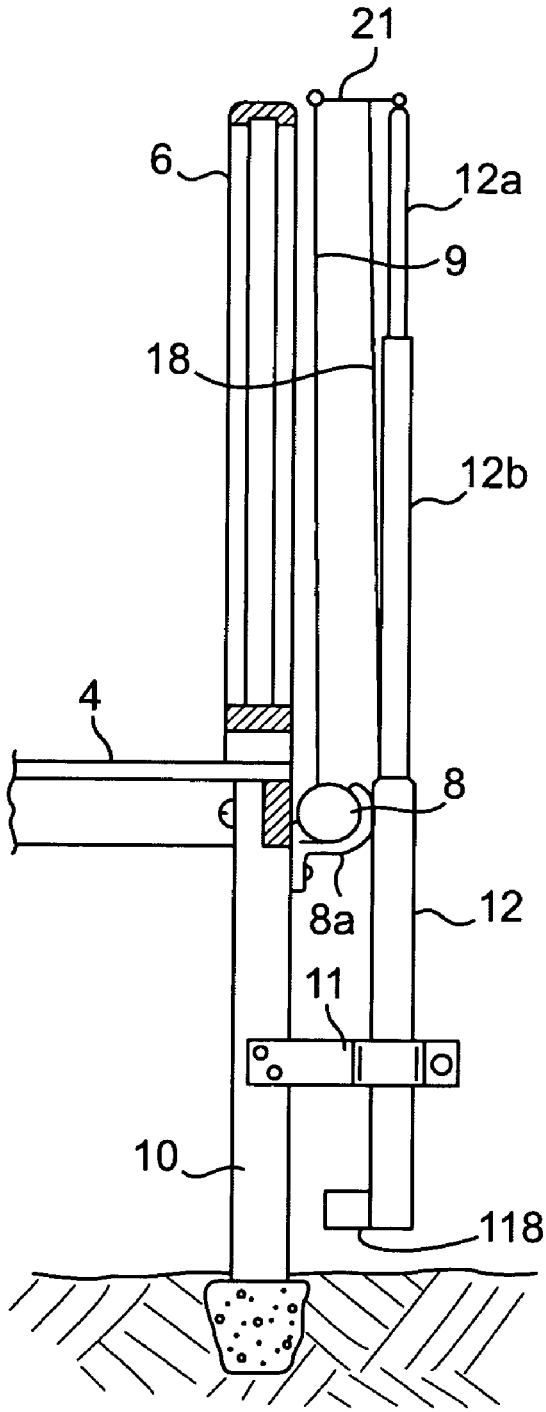
FIG. 3 illustrates a side view of the railing and the location of the screen erecting structure relative to the railing.
Figure 3A:
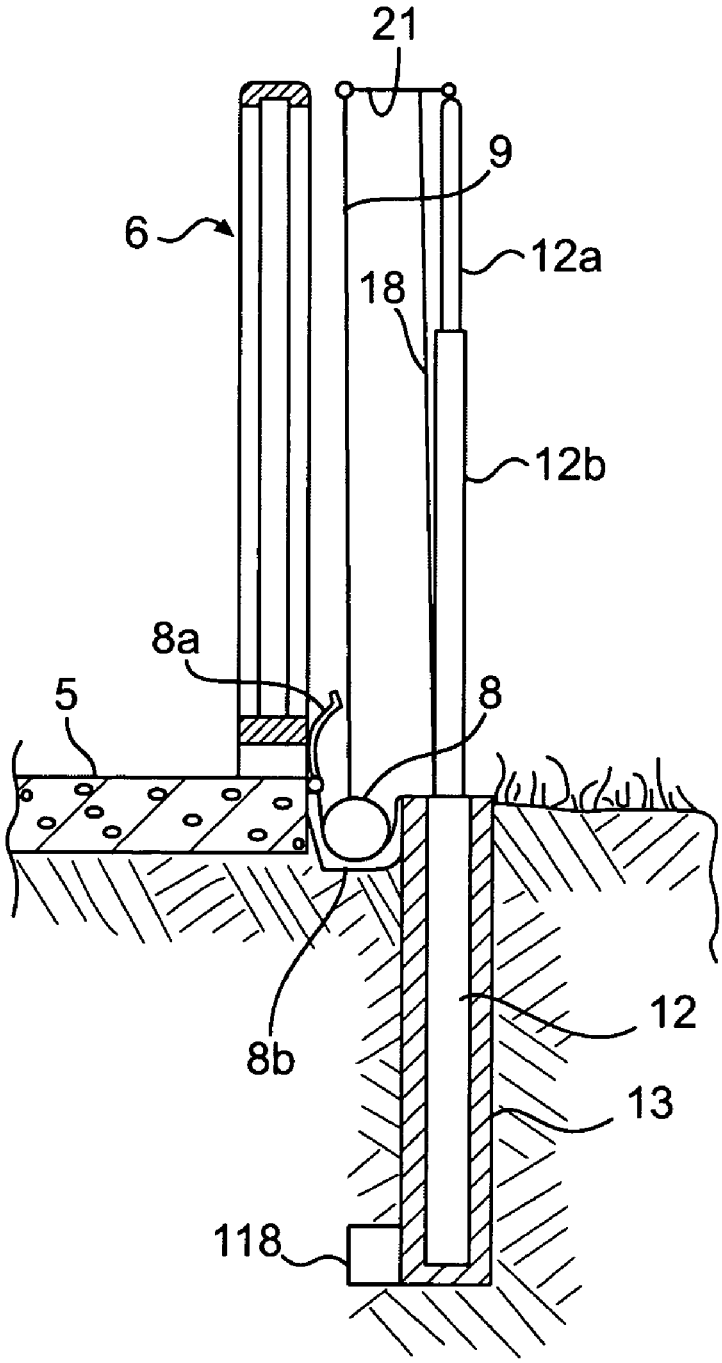
Figure 4:
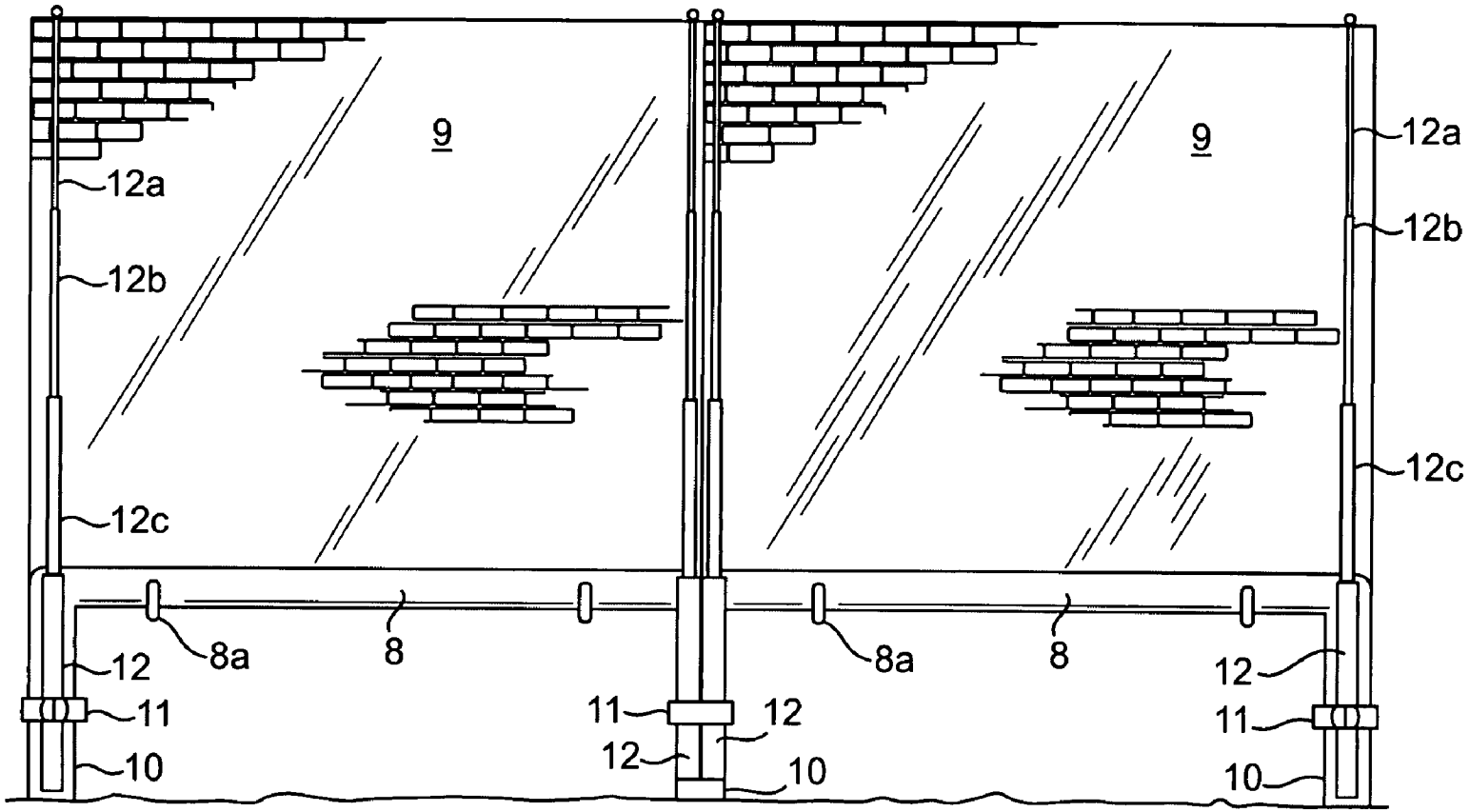
FIG. 4 illustrates front elevation of a fully erected screen.

Referring now to FIG. 1 of the accompanying drawings, a patio generally designated by reference numeral 2 has a deck 4 and a railing 6 upstanding therefrom. The deck has suspended below it screen rolls 8 individually suspended between deck support legs 10. In FIG. 3 it is seen that the legs 10 are supported in the ground and screen rolls 8 are supported by bracket 8A in front of the railing 6 so that when screens are raised, see FIG. 2, the railing is covered in this case with a screen 9 with a brick design. As shown in FIG. 3A, and as described below, canisters 12 can be positioned in the ground such that roll 8 rests at a level immediately below the surface of the ground in a roll holder 8*b*. Roll holder 8*b* can include a roll holder cover 8*c* to protect the roll 8 from debris and other foreign objects that may hinder proper operation of the roll 8. FIG. 4 illustrates the screen when raised to its full height, which will be determined for each occasion and in this case is significantly higher than the top of the deck rail.

Figure 5:
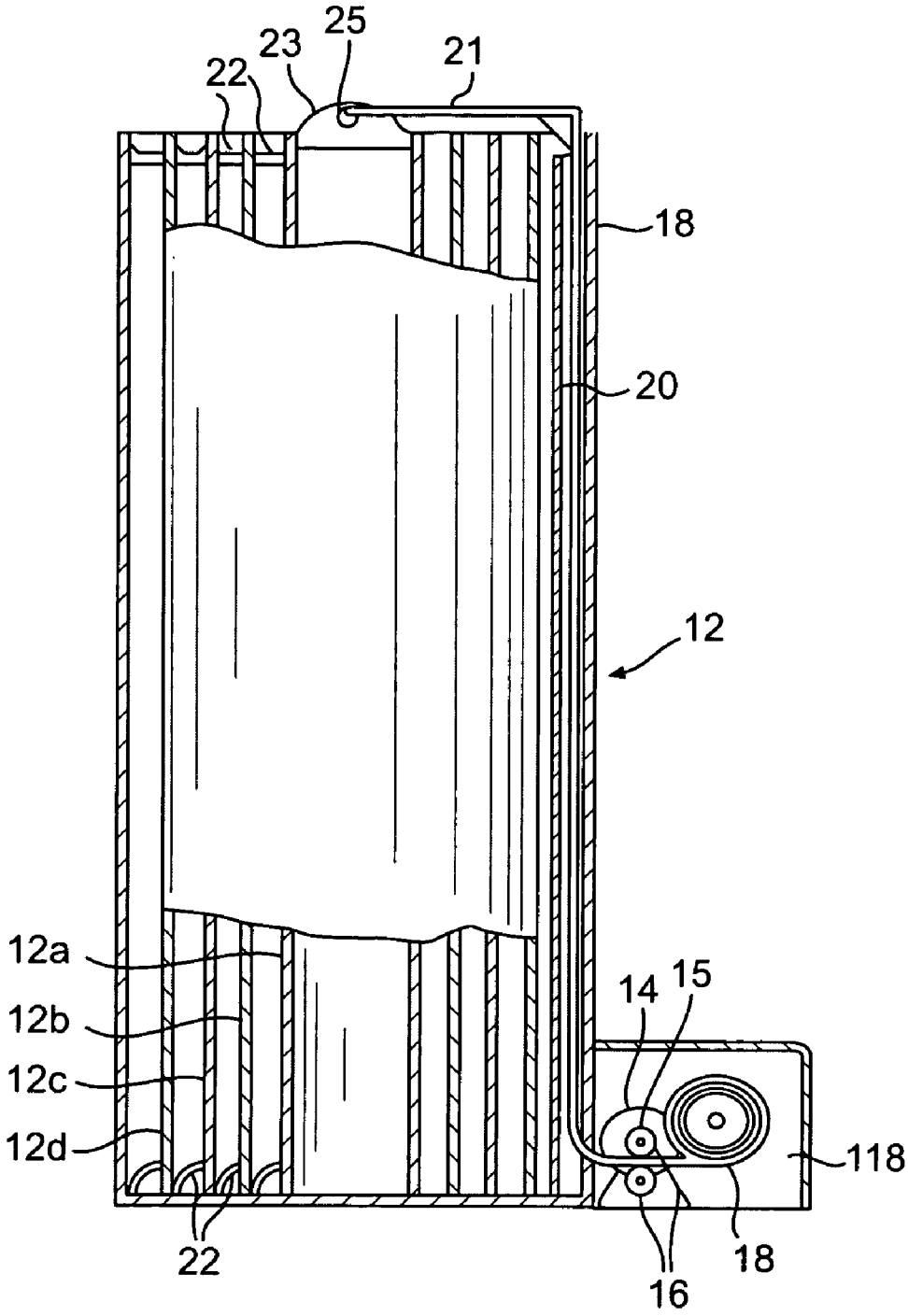
FIG. 5 is a view in partial section of a canister with telescoping members.
Figure 6:
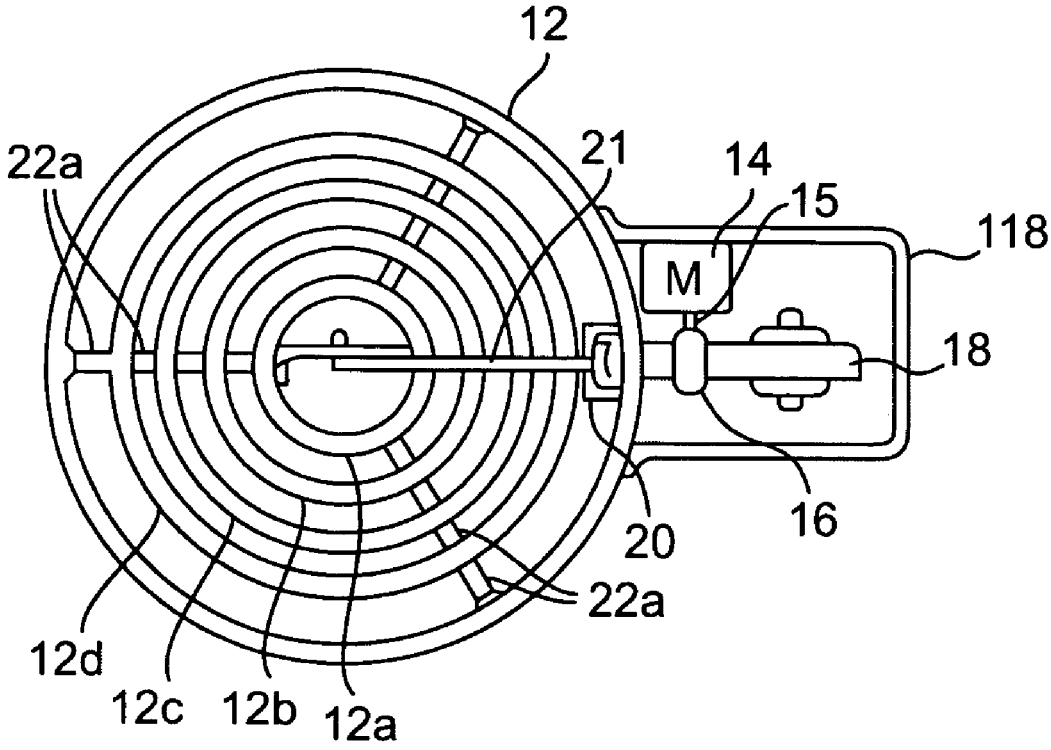
FIG. 6 is a top view of the canister of FIG. 5.

The structure illustrated employs canisters 12 such as illustrated in detail in FIGS. 5 and 6. Each canister 12 has a plurality of hollow telescoping tubes, 12*a*, 12*b*, 12*c* and 12*d* nested one within the other. The tubes may be raised manually, but preferably a motor 14 is employed to raise the innermost tube 12*a* of the group of tubes 12*a*–12*d*. The motor 14 drives, via shaft 15 and pinch rollers 16, a flexible metal tape 18 curved in cross-section for strength. The tape 18 is stored in a tape housing 118 adjacent canister 12 and is guided in a channel 20 and at its top end is connected via bar 21 to an upward projection 23 from the top of the tube 12*a* with an aperture 25. The shaft 15 could be manually rotated if a motor is not employed.

When the motor 14 is energized the tape is driven to its maximum height, the combined length of all tubes 12*a* to

12*d*. Each tube pulls up the next adjacent tube by means of interacting projections 22–22*a*, for instance, on adjacent tubes.

Rather than use simple contacting projections such as 22 and 22*a*, heavily spring biased balls may be used to latch each tube in its maximum upright position by extending into a deep recess in the adjacent tube.

Figure 7:
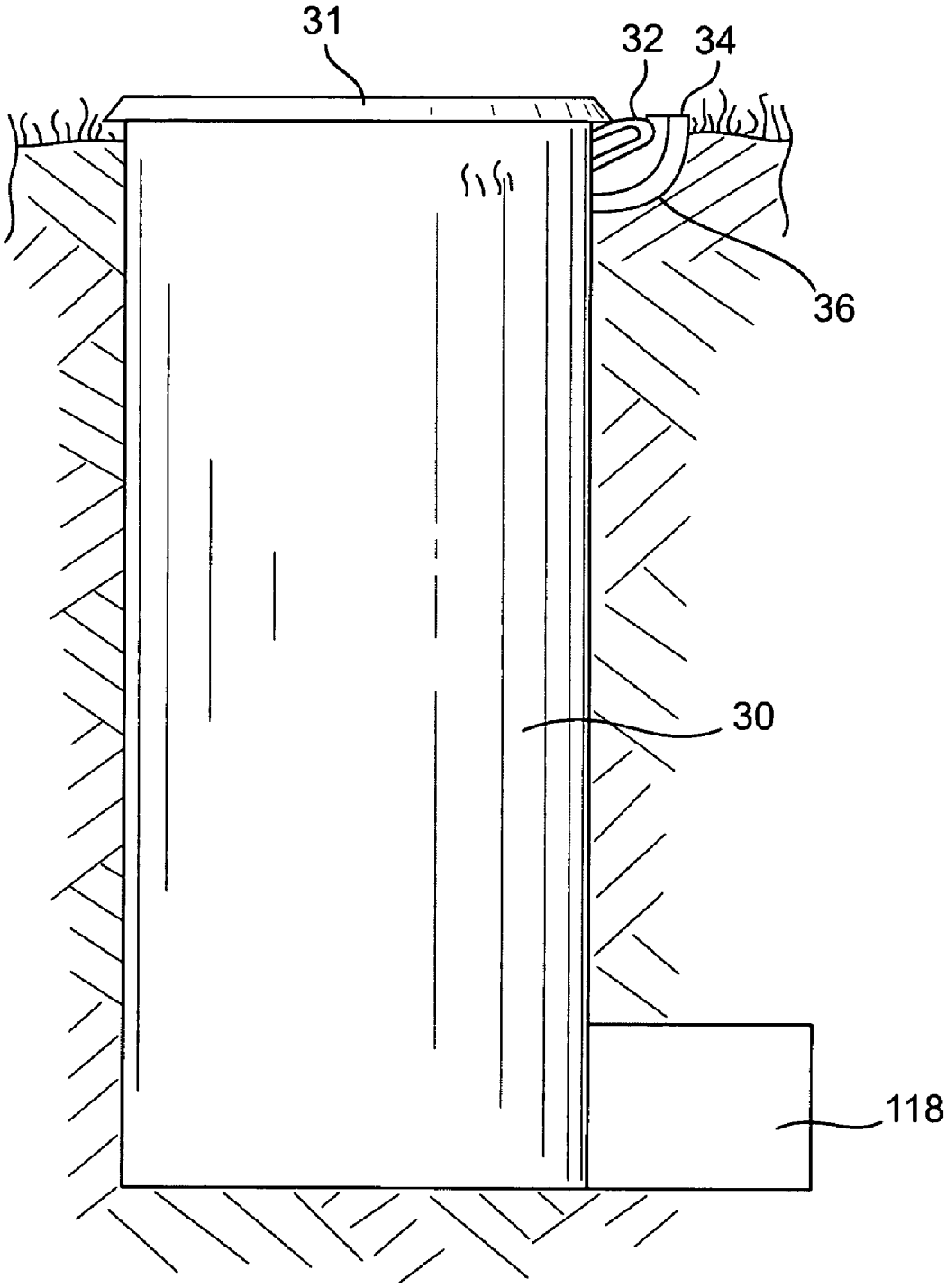
FIG. 7 is a side view of the canister used in the second embodiment of the invention.

In the second embodiment of the present invention, and reference is made to FIG. 7 of the drawings, a canister 30 is provided that is essentially the same as the canisters 12 of FIGS. 5 and 6. The only significant difference is that canisters 30 are buried in the ground to provide a perimeter at any desired location. Referring to FIG. 7, it is seen that the top of the canisters are at ground level so that they do not present obstacles. Caps 31 are provided for the canisters to exclude dirt and water. There is one other difference between the two embodiments, and this is also illustrated in FIG. 7. The canister designated by reference numeral 30 has a loop 32 to which a hook on the screen is to be attached. This arrangement anchors the bottom of the screens while the top may be anchored to the same aperture 23 as the arm 21, see FIGS. 5 and 6. Thus, the top and bottom of the screen are secured. The distance between canisters is basically a function of the screen material. Six feet is often an appropriate distance. It should be noted that the loop 32 is located in a bowl-like member 34 to protect it from dirt build-up around it. The member 34 has a hole 36 to allow for water drainage as does canister 30 by hole 37.

The screen material may be opaque or as in a one way mirror; the people inside the enclosure can see out, but the people on the outside can not see in. In this regard, see U.S. Pat. No. 5,680,893.

Once given the above disclosure, many other features, modifications and improvements will become apparent to the skilled artisan. Such features, modifications and improvements are, therefore, considered to be a part of this invention, the scope of which is to be determined by the following claims.

What is claimed is:

1. A device for supporting and erecting screens about an area to be shielded comprising canisters having a plurality of telescoping members, means for supporting said canisters in a generally vertical position, said members in a first position being at least partially retracted into its associated canister and in a second position extended at least partially beyond the canisters, a screen roll containing a screen, said screen in a first position is retracted at least partially into said screen roll and in a second position extends out from said screen roll, and means for supporting said screen in its second position between one or more of said members of said canisters in their second position, said means comprising a metal tape having an arcuate cross section.

2. A device for supporting and erecting screens according to claim 1 further comprising means for moving said members between said first and second positions.

3. A device for supporting and erecting screens according to claim 1 wherein said canisters are at least partially supported by members of a structure, and means for suspending said screen rolls horizontally below a top of said structure.

4. A device for supporting and erecting screens according to claim 3 wherein said screen rolls are supported parallel to an edge of and under the top of said structure.

5. A device for supporting and erecting screens according to claim 4 the structure has a railing, and means are provided for raising said screens to at least the height of said railing.

6. A device for supporting and erecting screens according to claim 1 wherein said canisters are supported from the bottom to the top of the canister, said canisters being spaced apart approximately by the horizontal width of each screen.

7. A device for supporting and erecting screens according to claim 1 further comprising means for tightly sealing the ends of the canisters against the elements.

8. A device for supporting and erecting screens according to claim 1 further comprising means of selectively maintaining said screens in at least one of said first and second positions.

9. A device for supporting and erecting screens according to claim 1 wherein said screens are opaque.

10. A device for supporting and erecting screens according to claim 1 wherein said screens can be seen through from only one side.

11. A device for supporting and erecting screens according to claim 4 further comprising loops formed on said canisters at their top level to receive hooks of said screens.

* * * * *